US006557666B1

(12) United States Patent
Drouin

(10) Patent No.: US 6,557,666 B1
(45) Date of Patent: May 6, 2003

(54) MODULAR HOARDING SYSTEM

(76) Inventor: Jean Drouin, 252 Clarence Street, Brampton, Ontario (CA), L6W 1T4

( * ) Notice: Subject to any disclaimer, the term of this patent is extended or adjusted under 35 U.S.C. 154(b) by 0 days.

(21) Appl. No.: 09/465,601

(22) Filed: Dec. 17, 1999

(30) Foreign Application Priority Data

Dec. 16, 1999 (CA) ..... 2292262

(51) Int. Cl.[7] ..... E04G 1/00

(52) U.S. Cl. ..... 182/129; 182/178.1; 182/178.5; 182/222

(58) Field of Search ..... 182/123, 129, 182/130, 222, 178.1, 178.2, 178.3, 178.4, 178.5, 179.1

(56) References Cited

U.S. PATENT DOCUMENTS 2,506,640 A * 5/1950 Hawes ..... 182/179.1 X
3,498,016 A * 3/1970 Nowak ..... 182/178.1 X
3,564,802 A * 2/1971 Dreyfus ..... 182/178.1 X
3,902,817 A * 9/1975 Meir ..... 182/178.5 X
4,214,734 A 7/1980 Stafford ..... 256/24
4,222,542 A * 9/1980 Wilson et al. ..... 248/243
4,340,130 A * 7/1982 Payne et al. ..... 182/222 X
4,426,171 A * 1/1984 Layher ..... 182/179.1 X
4,430,019 A * 2/1984 D'Alessio ..... 182/178.1 X
4,471,947 A * 9/1984 Osborne ..... 256/24
4,619,549 A * 10/1986 Gilbreth ..... 182/178.5 X
4,815,727 A * 3/1989 Kiribuchi ..... 182/178.1 X
4,852,317 A * 8/1989 Schiavello et al. ..... 52/239
4,877,109 A * 10/1989 Welch et al. ..... 182/183
4,967,878 A * 11/1990 Adams ..... 182/179
5,000,290 A * 3/1991 Seely ..... 182/222
5,054,580 A * 10/1991 Cheek ..... 182/179.1
5,145,030 A * 9/1992 Pavlescak et al. ..... 182/113
5,799,750 A * 9/1998 Garcia ..... 182/82
5,816,000 A * 10/1998 Izatt et al. ..... 52/238.1
5,941,345 A * 8/1999 D'Alessio ..... 182/178.1 X
5,965,053 A * 10/1999 Carlson ..... 249/191
6,119,810 A * 9/2000 Harder ..... 182/152
6,158,181 A * 12/2000 Musgrave et al. ..... 182/129 X

* cited by examiner

*Primary Examiner*—Bruce A. Lev
(74) *Attorney, Agent, or Firm*—Tim Bradley; Gardere Wynne Sewell LLP

(57) ABSTRACT

A modular hoarding includes vertical posts secured to the ground. The vertical posts are spaced apart. Detachable, horizontally oriented cross-members are secured to the vertical posts. Detachable wall panels are secured to the horizontally oriented cross-members. The wall panels are secured in abutting positions to form a modular wall structure. The cross-members and wall panels are secured to the posts and cross-members respectively so that the cross-members and panels may be detached after use. The cross-members may be secured at various selected positions along the vertical posts. Similarly, the wall panels may be secured to the cross-members at various selected positions relative to the cross-members.

39 Claims, 6 Drawing Sheets

MODULAR HOARDING SYSTEM

FIELD OF THE INVENTION

The invention relates generally to hoarding assembled around construction sites.

DESCRIPTION OF THE PRIOR ART

Hoarding is used to prevent pedestrians from entering a construction site and to prevent debris from escaping the site. Hoarding may also be used as temporary barriers to control pedestrian traffic during special events and out door activities. Basic hoarding is essentially a fence formed of wood beams or rectangular frames nailed together to serve as structural members, and wood cladding panels nailed to the structural members. Such hoarding often includes a covered walkway that usually consists of more wood beams nailed together to define a roof framework, and wood panels or boards laid on the framework. Such a walkway ensures that passers-by are protected against in jury from materials and debris accidentally dropped from a building.

There are several shortcomings to such prior practices. Assembly of a hoarding requires considerable time and labour and some measure of carpentry skill. Disassembly of the hoarding not only involves considerable time, and the beams and panels of the hoarding are discarded as waste. It would be desirable to provide a hoarding system which is not subject to such waste.

BRIEF SUMMARY OF THE INVENTION

In one aspect, the invention provides a modular hoarding comprising vertical posts and horizontal cross-members, preferably formed of tubular steel. The posts are positioned around the perimeter of a construction site by location in post holes, fastening to concrete surfaces, or other appropriate ways. Mounting features are provided to releasably secure the cross-members to the posts in a generally horizontal orientation. Panel structures are provided, preferably rectangular steel frames in which wood panels are permanently mounted. Mounting features are provided to secure each panel structure to the horizontal cross-members at a selectable height, accommodating variations in the surface on which the hoarding is erected. The mounting features preferably include a mounting structure fixed to each panel structure and formed with a set of vertically spaced openings. A removable mounting member may then be provided which has a key portion shaped to fit and lock into any of the openings, as by rotation between insertion and locking orientations, and which has a body portion shaped to extend rearward and downward about one of the cross-members.

In another aspect, the invention provides a covered walkway structure that can be incorporated into the basic fence structure defined by the modular hoarding. The walkway structure includes a set of uprights, each comprising a vertical support and a transverse bracket which has one end fixed to the support and an opposing free end. The support and bracket are preferably steel members welded or otherwise permanently fixed to one another at a predetermined angle. The free end of each bracket is releasably secured to one of the posts of the basic fence structure. In that regard, each bracket is associated with mounting features, preferably a vertical sleeve fixed to the free end of the bracket, and dimensioned to slide about any of the vertical posts. Panels or boards are placed on the brackets to serve as a roof, protecting the pedestrians from falling debris or construction materials dropped from above. The brackets are preferably angled downward from their respective vertical supports so that falling objects roll back into the construction site. Mesh and releasable cross-members may be fastened between the vertical supports of walkway structure to impart structural rigidity and to confine pedestrians to the covered walkway.

In another aspect of the invention, a method of erecting a modular hoarding is provided. The method comprises the steps of providing a plurality of vertical posts, securing the posts to the ground, securing a plurality of cross-members to the posts in a substantially horizontal orientation, and securing a plurality of panel members to the horizontally oriented cross-members. The cross-members are secured to the posts in a manner which permits the cross-members to be disassembled for later re-use. Also, the panels are secured to the cross-members in a manner which allows the panels to be disconnected from the cross-members so that the panels may be reused.

The invention permits basic fence-type hoarding and hoarding with covered walkways to be assembled and disassembled quickly by relatively inexperienced workers. It also reduces the risk of damage to hoarding components, allowing repeated use at different construction sites. The term "modular" as used in this specification in respect of hoarding should be understood as meaning a hoarding which is assembled from sets of standard prefabricated components and which can be expanded or reduced in size by adding or eliminating a number of these components.

Particular aspects of the invention have been summarized above. Others will be apparent from the drawings and a description of a preferred embodiment set out below, and will be more specifically defined in the appended claims.

BRIEF DESCRIPTION OF THE DRAWINGS

The invention will be better understood with reference to drawings in which.

DESCRIPTION OF PREFERRED EMBODIMENTS

Figure 1:
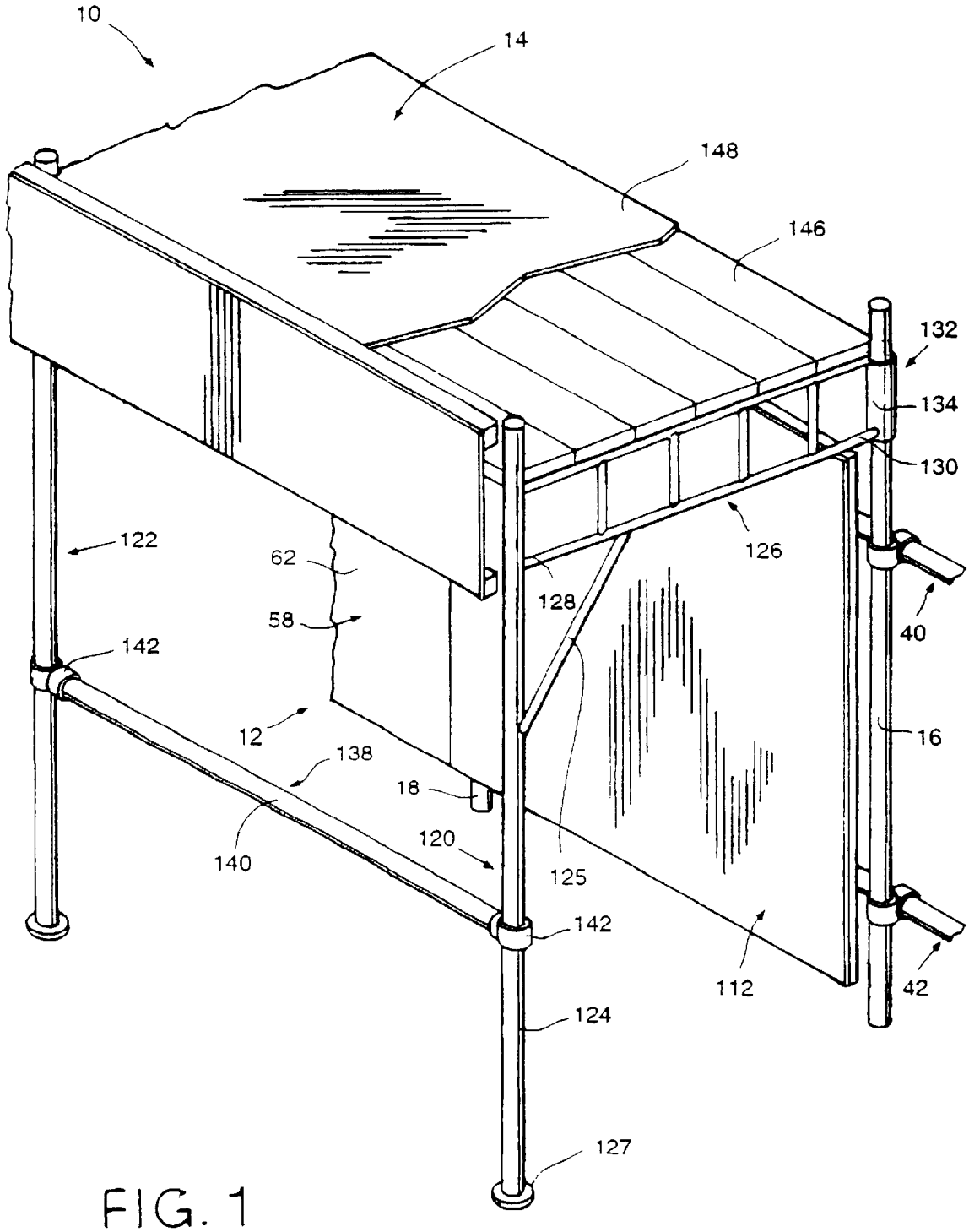
FIG. 1 is a fragmented perspective view of a hoarding system which defines both a fence and a covered walkway.
Figure 2:
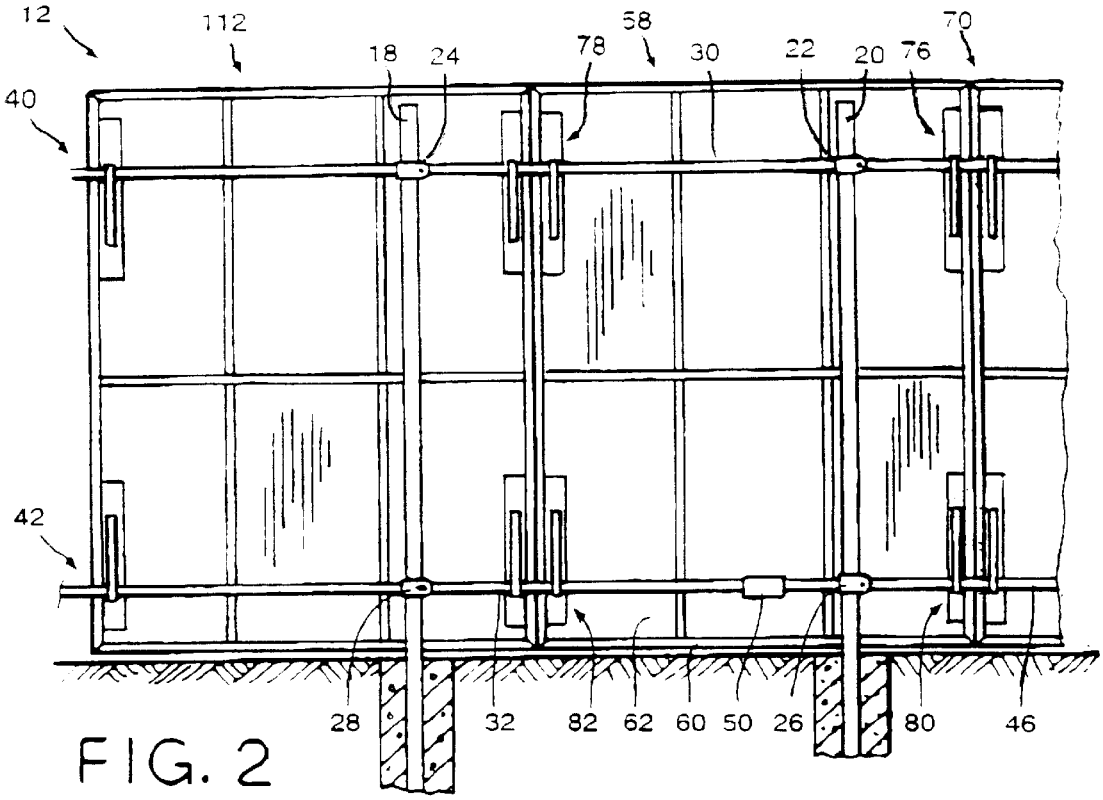
FIGS. 2–4 are fragmented rear, front and side views of the fence.
Figure 3:
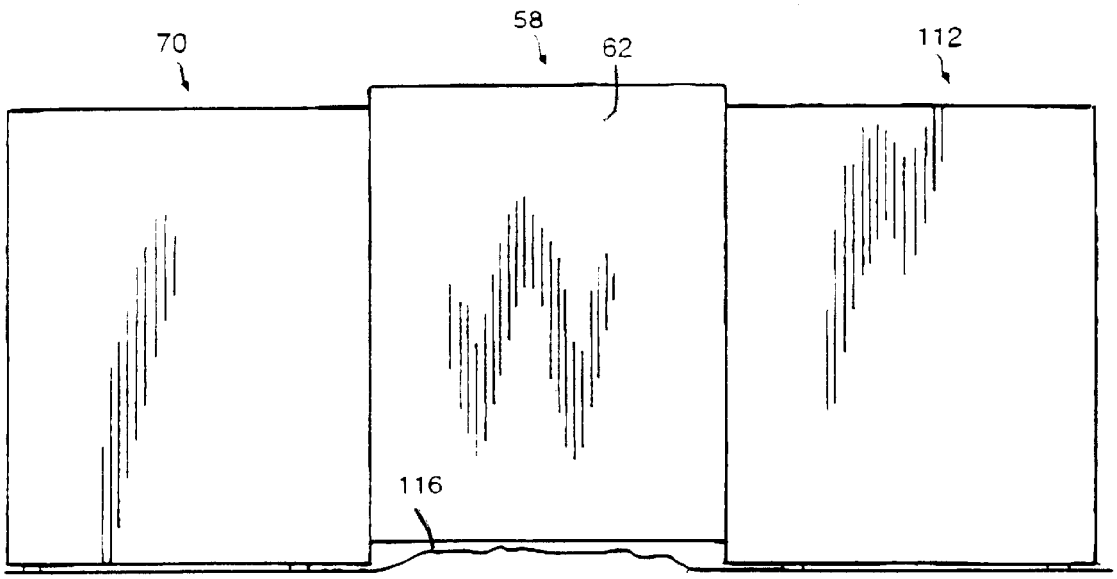

Reference is made to FIGS. 1–3 which illustrate a modular hoarding 10. The hoarding 10 includes a fence 12 which extends about the perimeter of a construction site and a covered walkway 14. The fence 12 is formed with modular components adapted to assemble and disassemble easily: tubular steel posts, tubular cross-members, wall panels, and releasable mounting assemblies that join the various components. The fence 12 may be assembled in straight line segments at each side of a construction site. Corner structures are generally not required where sections of the fence 12 meet.

Figure 4:
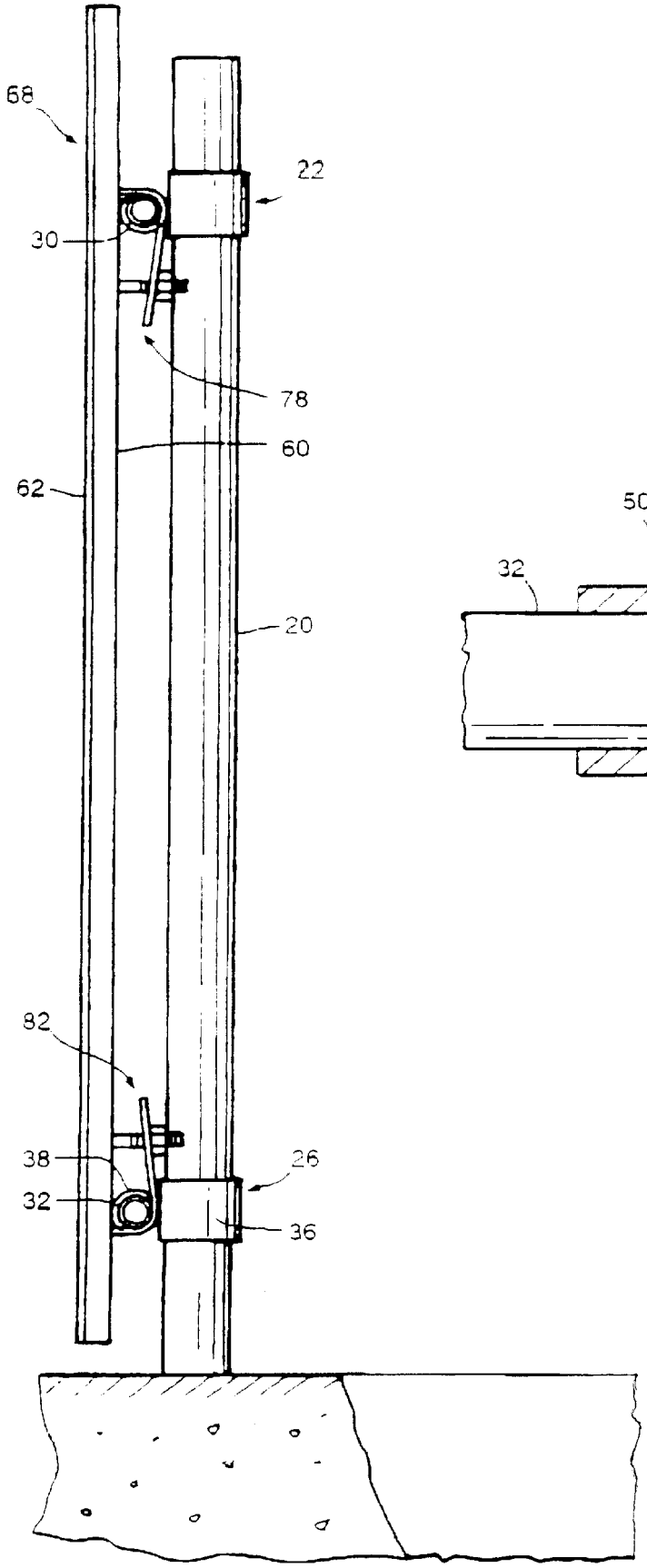

The fence 12 is assembled in sections. Fence posts are installed at intervals along the perimeter of the site, such as the three such posts 16, 18, 20, apparent in FIG. 1 (posts 16 and 18) and FIG. 2 (posts 18 and 20). In most instances, holes will be dug to receive the posts, but the posts may be formed with apertured flanges for fastening to pavement or other durable surfaces. In some instances, the fence posts may be driven into the ground. Two posts 18, 20 associated with a particular section of the fence 12 are apparent in FIG. 2. A pair of conventional pipe clamp fasteners 22, 26 are mounted to one post 20 and another pair of fastener 24, 28, to the other post 18 in order to releasably mount horizontal cross-members 30, 32. The fastener 26, which is typical, is further detailed in FIG. 4 where it may be seen to comprise two sleeves 36, 38 aligned along axes that are offset horizontally and mutually perpendicular. The sleeve 36 is located vertically about the post 18, and split so that it can be tightened with a bolt to secure the fastener 24 at a desired height relative to the post 18. The other sleeve 38 is oriented horizontally to receive and support the cross-member 32. The upper cross-member 30 is simply slipped horizontally through the upper fasteners 22, 24, and the lower cross-member 32, through the lower fasteners 26, 28, where the cross-members 30, 32 respectively constitute part of upper and lower rails 40, 42 on which panels are suspended.

Figure 5:
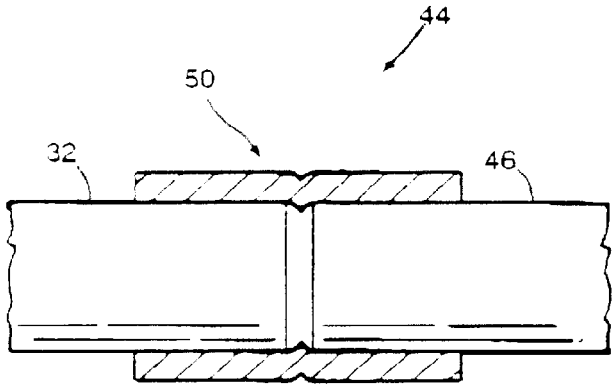
FIG. 5 is a fragmented side view of the junction between adjacent horizontal cross-members used to support wall panels in the fence.

The injunction 44 between two cross-members 32, 46 in the lower rail 42 is detailed in the enlarged view of FIG. 5. A conventional pipe connecting sleeve 50 is used to join the adjacent cross-members 32, 46. The sleeve 50 is obtained circumferentially pinched, which causes the sleeve 50 to fit tightly about a pipe inserted into either end of the sleeve 50 and displaced substantially to the center of the sleeve 50. The sleeve 50 is simply fitted over the end of one cross-member 32, and the adjacent end of the other cross-member 46 is simply inserted into the sleeve 50. Such joining of cross-members causes the sections of the fence 12 to act together as a unitary structure.

A typical wall panel 58 includes a rectangular frame 60 formed of angled-iron, and a wood panel 62 fastened to the outer planar face of frame 60. These components are apparent in FIGS. 2–4, and detailed in the fragment view of FIG. 6. The wood panel 62 is fastened to the rectangular frame 60 with self-tapping screws (like the screw 66 associated with the adjacent panel 70) which are screwed at intervals along the frame 60.

Special mounting assemblies are used to fasten wall panels to the cross-members of the hoarding 10. The mounting of the panel 58 is typical, and general aspects of such mounting will be apparent with reference to FIGS. 1 and 2. An upper pair of mounting assembles 76, 78 secures the panel 58 to the upper cross-member 30. A lower pair of mounting assembles 80, 82 secures the panel 58 to the lower cross-member 32.

Figure 6:
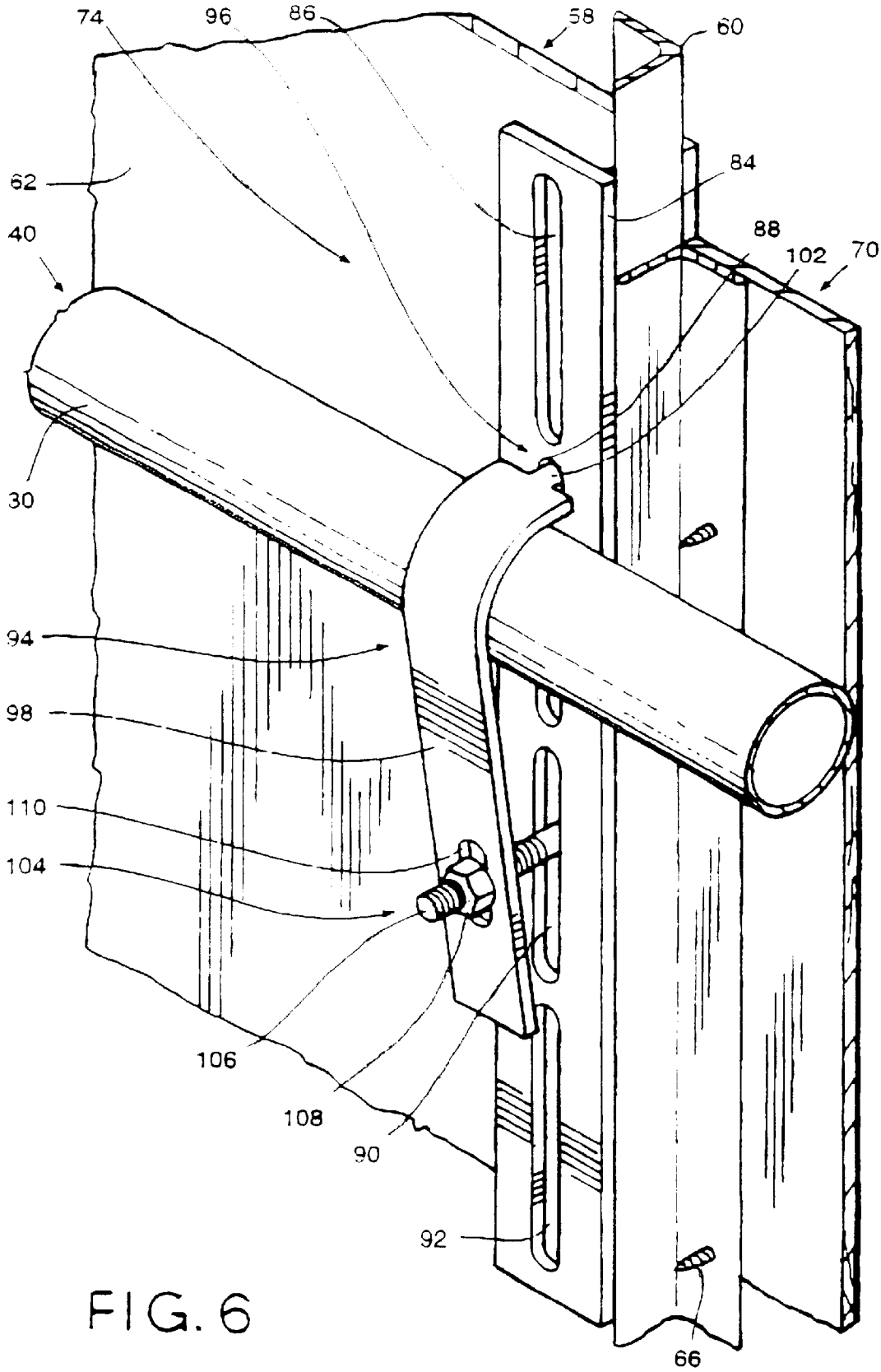
FIG. 6 is a fragmented perspective view of a panel mounting assembly on one wall panel.
Figure 7:
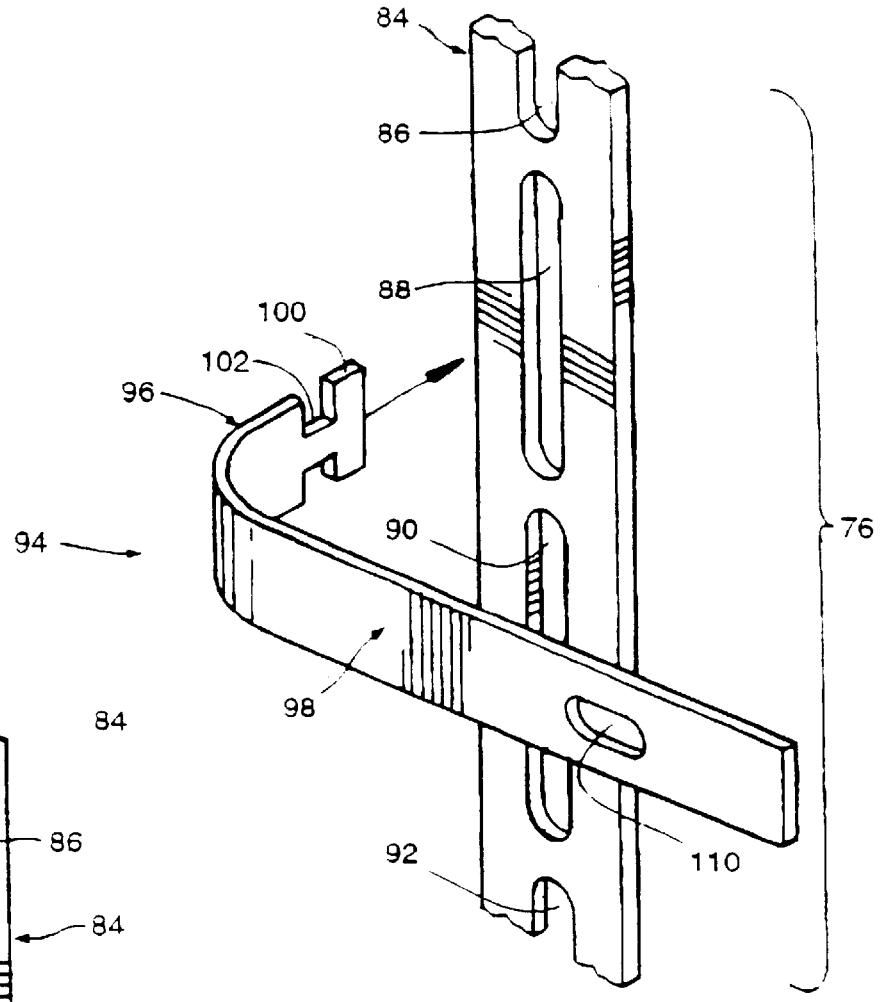
FIGS. 7 and 8 are fragmented perspective and elevational views showing how components of the panel mounting assembly interlock.
Figure 8:
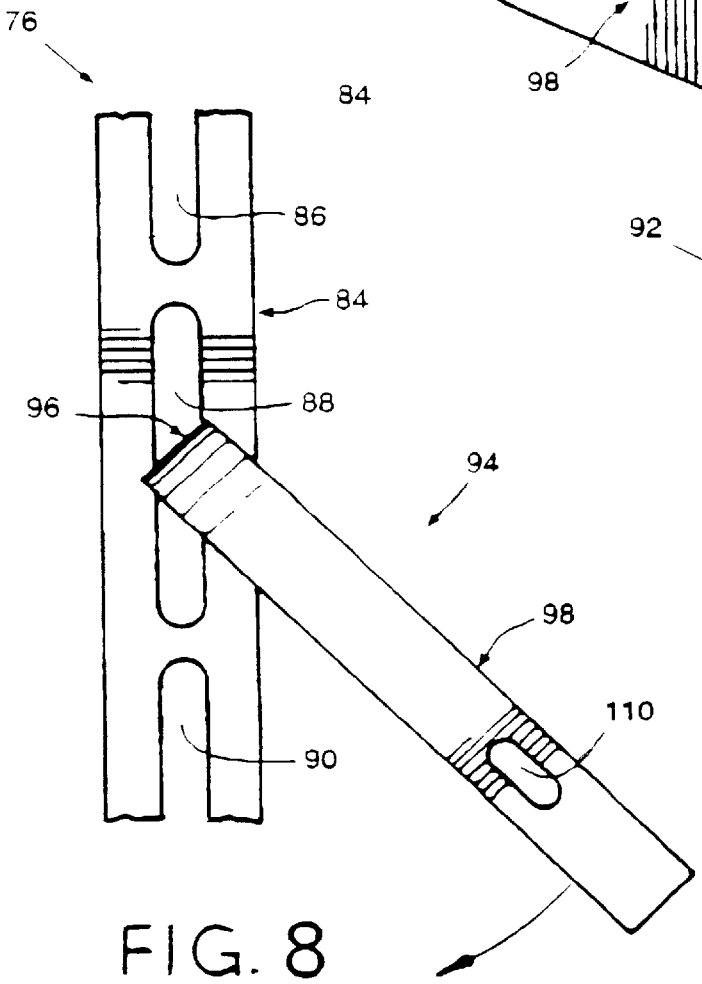

The mounting assembly 76 associated with the panel 58 is typical and detailed in FIGS. 6–8. It includes a mounting plate 84 welded to the frame 60 of the panel 58 and facing rearward from the panel 58. The mounting plate 84 has a set of four slots 86, 88, 90, 92 that are vertically aligned and spaced-apart. The mounting assembly 76 also includes a removable mounting member 94. The removable mounting member 94 includes a key portion 96 and a body portion 98 angled essentially to define a hook. The key portion 96 is generally planar with a thickness less than width of the slots 86–92, and has an elongate head 100 and a narrow neck 102 dimensioned to rotate within, for example, the slot 88. The key portion 96 is essentially shaped to insert in a predetermined angular orientation relative to the slot 88, with the mounting member 94 essentially horizontal, as shown in FIG. 7, until the neck 102 of the key portion 96 locates within the slot 88, and the head 100, behind the mounting plate 84. The mounting member 94 is then rotated downward through 90 degrees to an operative vertical orientation about the cross-member, as shown in FIG. 2. The head 100 then bears against the back of the mounting plate 84 to resist removal, and the body portion 98 extends rearward from the panel 58 and then downward about the cross-member. The mounting member 94 is secured to the mounting plate 84 with a threaded fastening assembly 104. The fastening assembly 104 consists of a bolt 106 and a nut 108. The body portion 98 of the removable mounting member 94 is formed with a slot 110 positioned to align with the slot 90 of the mounting plate 84, immediately below the slot 88 through which the key portion 96 of the removable mounting member 94 is inserted. The bolt 106 is simply extended through the aligned slots 90, 106, and the nut 108 is rotated to draw the body portion 98 of the removable mounting member 94 securely against the cross-member 30.

In practice, the upper and lower rails 40, 42 set the general height of all wall panels. The mounting assemblies, however, permit the height of individual panels to be adjusted to accommodate irregularities in site surfaces. For example, as shown in FIG. 3, the wall panel 58 is raised relative to adjacent panels 70, 112 to accommodate a local rise 116 in the supporting surface.

Figure 9:
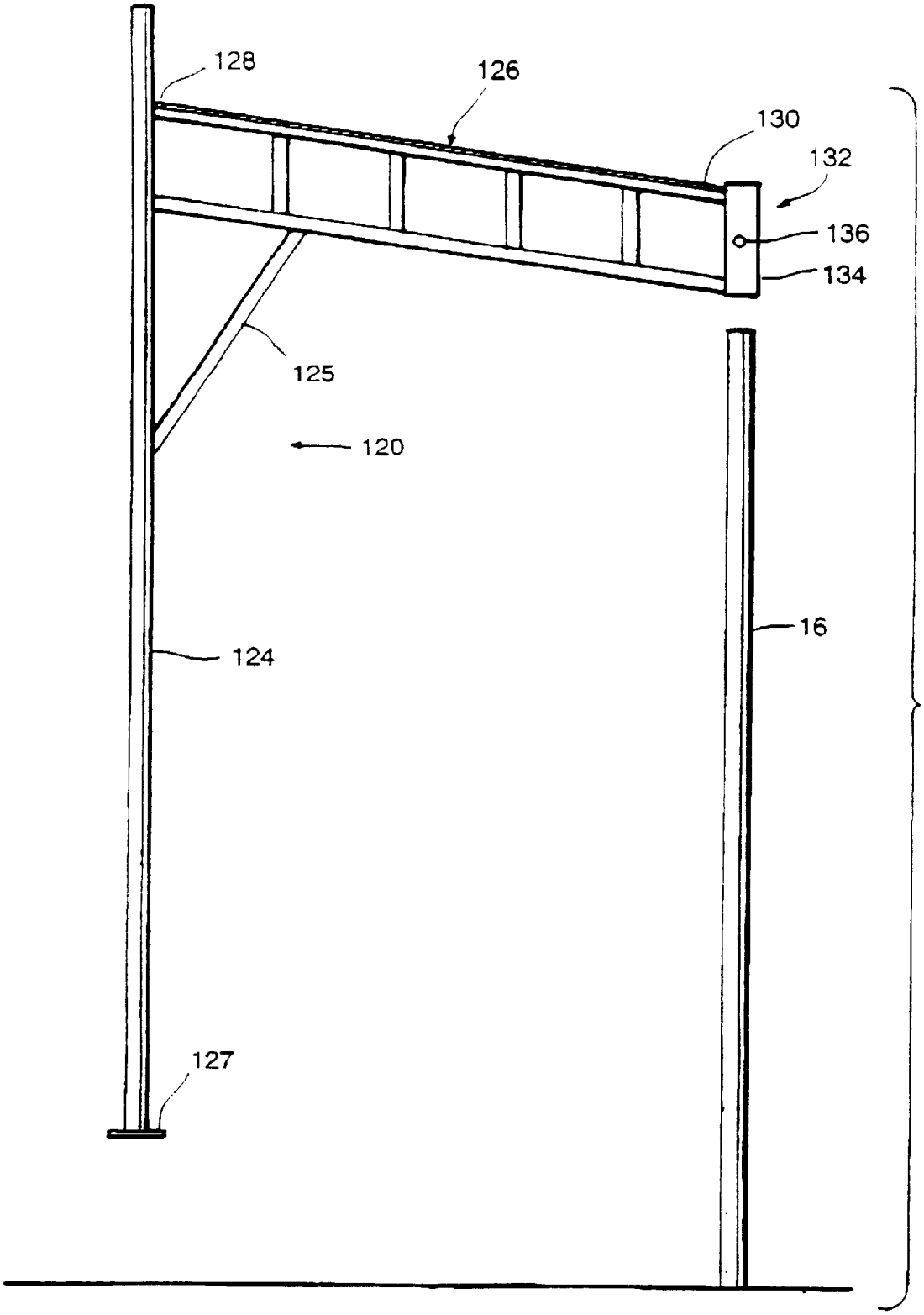
FIG. 9 is an exploded side elevation showing an upright used to construct the walkway in which the upright is mounted to a post associated with the fence.

The walkway 14 has a modular construction which includes standard uprights, such as the uprights 120, 122 apparent in FIGS. 1 and 9. The upright 120 which is typical includes a vertical support 124 and a transverse bracket 126 welded to the support 124. The support 124 is a steel pipe but the bracket 126 has a truss construction to impart greater rigidity. A brace 125 is welded at an angle between the support 124 and the bracket 126 to further reduce sagging. In practice, the support 124 may be sunk in the ground, or a circular flange 127 with clearance holes (not shown) may be welded to the lower end of the support 124 to permit fastening to pavement. The bracket 126 inclines downward at a predetermined angle (roughly 15 degrees) from its fixed end 128 at the support 124 to its free end 130 distant from the support 124.

The bracket 126 of the upright 120 is mounted releasably to the post 16 of the fence 12. The mounting assembly 132 includes a sleeve 134 dimensioned to locate about the fence post 16 (or any other fence post in the fence 12). The sleeve 134 is welded in a vertical orientation to the free end 130 of the bracket 126. During assembly, the upright 120 is raised, as shown in FIG. 9, to align the sleeve 134 with the post 16, and then lowered to locate the sleeve 134 about the post 16. A set screw 136 threaded into the sleeve 134 can be rotated to bear against the post 16. Each upright is mounted to a different fence post in a similar manner. The mounting arrangement is not only simple, but permits manual rotation of the uprights 120, 122 about their associated posts to adjust spacing during connection of cross-members between the supports. A typical cross-member 138 is shown in FIG. 1. It consists of length of steel or aluminum tube 140, and conventional pipe fasteners 142 mounted at opposing ends of the tube 140 and adapted to fasten about the adjacent supports. Such cross-members add structural rigidity and also define a horizontal rail. Conventional wire mesh or other fencing material (not shown) may be extended between the uprights 120, 122 and fastened with wire ties to both the uprights 120, 122 and cross-member 138 to further enhance the rigidity of the walkway and to constrain pedestrian movement.

In the hoarding section illustrated in FIG. 1, the transverse brackets associated with the uprights 120, 122 align to define a, roof supporting structure. The mounting of roof materials is less critical than that of the wall panels. Wood boards 146 are simply laid over the brackets, and wood panels 148 are rested on the boards 146. The angular inclination of the brackets, downward toward the interior of the construction site, ensures that rain and materials dropped onto the walkway 14 roll toward the interior of the construction site.

The hoarding 10 is very simply assembled. The fence posts are erected at intervals and exact spacing is not critical. The pipe clamp-type connectors are then mounted on the posts at desired heights, and the cross-members are slipped through the connectors. Adjacent ends of the cross-members are joined to define continuous upper and lower rails from mounting of wall panels. The wall panels are simply butted against the outer surfaces of the horizontal cross-members, and secured by inserting, rotating and fastening the removable mounting members. The uprights are then installed with their mounting sleeves located about the fence posts. The uprights may be rotated about the axes of their respective fence posts to adjust relative spacing and facilitate installation of cross-members. The set screws associated with the mounting of the uprights may be set, and post holes may be filled (or connecting flanges may be fastened to pavement). Roofing materials are then placed on the aligned braces. The hoarding 10 is disassembled by essentially reversing the series of assembly steps. The various joints and mounting assemblies permit easy releasing of component without damage. Standard components can be added or removed to accommodate different sites.

It will be appreciated that particular embodiments of the invention have been described and that modifications may be made therein without departing from the spirit of the invention or necessarily departing from the scope of the appended claims.

I claim:

1. A modular hoarding comprising:

a plurality of spaced apart vertical posts;

a plurality of horizontal cross-members;

a plurality of releasable mounts to secure pairs of the cross-members to adjacent pairs of the posts;

each pair of the cross-members being secured to an adjacent pair of the posts, the pair of cross-members and the secured pair of posts defining a framework;

a plurality of generally planar panel structures; and, a plurality of releasable mounts associated with each of the panel structures to secure the panel structure to the framework at a height selectable from a range of heights defined relative to the framework.

2. The modular hoarding of claim 1 in which the releasable mounts associated with each of the panel structures comprise:

a mounting structure fixed to the panel structure and defining a plurality of vertically spaced openings; and, a removable mounting member comprising a key portion shaped to fit and lock into any one of the plurality of openings and a body portion shaped to extend about one of the cross-members.

3. The modular hoarding of claim 2 in which:

each of the openings in the mounting structure is an elongate slot; and, the key portion of the removable mounting member comprises a head portion shaped for insertion into the slot in a predetermined angular orientation and to resist removal from the slot in other angular orientations and a neck portion attached to the body portion and dimensioned to rotate within the slot.

4. The modular hoarding of claim 3 in which the releasable mounts associated with each of the panel structures comprises:

an opening in the fixed mounting structure;

an opening in the body portion of the removable mounting member aligned with the opening in the fixed mounting structure; and, a threaded fastener assembly extending through the aligned openings.

5. The modular hoarding of claim 1 further comprising a covered modular walkway structure, the walkway structure comprising:

a plurality of upright structures, each of the upright structures comprising a vertical support and a transverse bracket, the bracket comprising a fixed end fixed to an upper portion of the support and a free end spaced from the support;

a bracket fastener associated with each of the free ends of the brackets for releasably securing the free end to one of the posts;

a plurality of roof panel structures mounted on the brackets.

6. The modular hoarding of claim 5 in which the bracket fasteners comprise a vertical sleeve fixed to the free end of each of the brackets and located about one of the posts.

7. The modular hoarding of claim 1, comprising a mounting structure secured to the panel structure, and wherein the releasable mounts associated with each of the panel structures comprises a clamping member operating between first and second positions, the clamping member engaging the mounting structure when the clamping member is in the first position, and the clamping member releasably secured to the mounting structure when in the second position.

8. The modular hoarding of claim 7, wherein each mounting structure defines a plurality of vertically spaced openings, the clamping member comprising:

a. a first end further comprising a key portion for insertion into at least one of the openings; and b. a second end releasably secured to the mounting structure when the clamping member is in the second position.

9. The modular hoarding of claim 8, wherein the clamping member comprises a body portion intermediate of the first and second ends, the body portion defining a clamp for releasably securing one of the cross-members.

10. The modular hoarding as claimed in claim 1, wherein the panel structures are releasably securable at a plurality of locations along the horizontal cross-members.

11. A modular hoarding providing a covered walkway, the modular hoarding comprising:

a plurality of spaced apart vertical posts;

a plurality of horizontal cross-members;

a plurality of cross-member mounts for releasably securing pairs of the cross-members to adjacent pairs of the posts;

each pair of the cross-members and the secured pair of posts defining a framework;

a plurality of generally planar, vertical wall panel structures;

a plurality of panel structure mounts associated with each of the wall panel structures for releasably securing the wall panel structure to the framework at a height selectable from a range of heights defined relative to the framework;

a plurality of uprights, each of the uprights comprising a vertical support and a transverse bracket inclined at a predetermined angle relative to the vertical support, the transverse bracket comprising a fixed end fixed to the support and a free end spaced from the vertical support;

a plurality of bracket mounts associated with each of the brackets for releasably securing the free end of the associated bracket to a different one of the posts; and a plurality of generally planar roof panel structures supported on the brackets.

12. The modular hoarding of claim 11 in which the wall panel mounts associated with each of the wall panel structures comprise:

a mounting structure fixed to the wall panel structure and defining a plurality of vertically spaced openings; and, a removable mounting member comprising a key portion shaped to fit and lock into any one of the plurality of openings and a body portion shaped to extend about one of the cross-members.

13. The modular hoarding of claim 12 which:

each of the openings in the mounting structure is an elongate slot; and, the key portion of the removable mounting member comprises a head portion shaped to insert into the slot in a predetermined angular orientation and to resist removal from the slot in other angular orientations and a neck portion attached to the body portion and dimensioned to rotate within the slot.

14. The modular hoarding of claim 13 in which the wall panel mounts associated with each of the wall panel structures comprises:

an opening in the fixed mounting structure below the one cross-member;

an opening in the body portion of the removable mounting member aligned with the opening in the fixed mounting structure; and, a threaded fastener assembly extending through the aligned openings.

15. The modular hoarding of claim 14 in which the bracket mounts comprise a vertical sleeve fixed to the free end of each of the brackets and located about the post to which the associated bracket is mounted.

16. A method of providing a modular hoarding supported at a pre-selected ground site, comprising the steps of:

providing a plurality of vertical posts;

securing the posts to the ground in spaced apart orientation;

releasably securing a plurality of horizontal cross-members to the posts;

each pair of the cross-members being releasably secured to an adjacent pair of the spaced apart posts to define a framework;

providing a plurality of abutting panel members; and releasably securing the panel structures to the framework at a height selectable from a range of vertically offset positions relative to the framework.

17. The method of claim 16 comprising the step of releasably coupling a first cross-member to a second cross-member positioned in adjacent alignment with the first cross-member.

18. The method of claim 17 comprising the step of positioning the horizontal cross-members at selected positions vertically along the posts.

19. The method of claim 18 wherein the cross-members are slidably positioned along the posts and are secured by clamping the cross-members to the posts.

20. A modular hoarding comprising:

a plurality of vertical posts;

a plurality of horizontal cross-members;

a plurality of releasable mounts to secure the cross-members to the posts;

a pair of the horizontal cross-members and a spaced adjacent pair of said vertical posts defining a framework when the pair of cross-members are interposed between and secured to the spaced adjacent pair of vertical posts;

a plurality of generally planar panel structures;

one or more vertical tracks associated with each of the panel structures to releasably secure the panel structure at a selectable height along a plurality of vertically spaced mounting positions defined by the one or more vertical tracks;

a removable locking member associated with each vertical track, the locking member comprising: a key portion to releasably engage the vertical track at the selectable height; and a body portion to releasably engage the framework.

21. The modular hoarding of claim 20, wherein the vertical track defines a plurality of vertically spaced openings, and the key portion is shaped to fit and lock into any one of the plurality of openings.

22. The modular hoarding of claim 21 wherein:

each of the openings in the vertical track is an elongate slot; and the key portion comprises: a head portion shaped for insertion into the slot in a predetermined angular orientation and to resist removal from the slot in other angular orientations; and a neck portion attached to the body portion and dimensioned to rotate within the slot.

23. The modular hoarding of claim 22 wherein the vertical track is fixed to the panel structure, the track comprising:

an opening defined by the body portion aligned with an opening in the vertical track; and, a threaded fastener assembly extending through the aligned openings.

24. The modular hoarding of claim 23 wherein the body extends about and securely engages one of the cross-members.

25. The modular hoarding of claim 20 further comprising a covered modular walkway structure, the walkway structure comprising:

a plurality of upright structures, each of the upright structures comprising a vertical support and a transverse bracket, the bracket comprising a fixed end fixed to an upper portion of the support and a free end spaced from the support;

a bracket fastener associated with each of the free ends of the brackets for releasably securing the free end to one of the posts;

a plurality of roof panel structures mounted on the brackets.

26. The modular hoarding of claim 25 which the bracket fasteners comprise a vertical sleeve fixed to the free end of each of the brackets and located about one of the posts.

27. The modular hoarding of claim 23 wherein the vertical track is secured to the panel structure, and the removable locking member operates between first and second positions, the locking member disengages the vertical track when the locking member is in the first position; and the locking member is releasably secured to the vertical track when in the second position.

28. The modular hoarding of claim 27 wherein each vertical track defines a plurality of vertically spaced openings, the key portion engages the track upon insertion into one of the openings; and, the body portion is releasably secured to one of the cross-members when the locking member is in the second position.

29. The modular hoarding of claim 28 wherein the body portion defines a clamp for releasably securing the cross-member.

30. The modular hoarding as claimed in claim 20, wherein the panel structures are releasably securable at a plurality of locations along the horizontal cross-members.

31. A modular hoarding providing a covered walkway, the modular hoarding comprising:

a plurality of vertical posts;

a plurality of horizontal cross-members;

a plurality of cross-member mounts for releasably securing the cross-members to the posts;

a plurality of generally planar, vertical wall panel structures;

one or more releasable vertical tracks associated with each of the wall panel structures for releasably securing the wall panel structure to one or both of a corresponding pair of cross-members;

the panel structure being releasably secured at a height selected along a plurality of vertically spaced mounting positions defined by the one or more vertical tracks;

a removable locking member associated with each vertical track, the locking member comprising: a key portion releasably engaging the vertical track at the selected height; and a body portion releasably engaging one of the corresponding cross-members;

a plurality of uprights, each of the uprights comprising a vertical support and a transverse bracket inclined at a predetermined angle relative to the vertical support, the transverse bracket comprising a fixed end fixed to the support and a free end spaced from the vertical support;

a plurality of bracket mounts associated with each of the brackets for releasably securing the free end of the associated bracket to a different one of the posts; and a plurality of generally planar roof panel structures supported on the brackets.

32. The modular hoarding of claim 31 in which each of the vertical tracks is fixed to the wall panel structure and defines a plurality of vertically spaced openings; and, the key portion is shaped to fit and lock into any one of the plurality of openings and the body portion is shaped to extend about the one releasably engaged cross-member.

33. The modular hoarding of claim 32 in which:

each of the openings in the vertical track is an elongate slot; and, the key portion comprises: a head portion shaped to insert into the slot in a predetermined angular orientation and to resist removal from the slot in other angular orientations; and a neck portion attached to the body portion and dimensioned to rotate within the slot.

34. The modular hoarding of claim 33 wherein one or more vertical tracks is secured to an associated wall panel structure, and a fastener assembly extends through a first opening defined by the vertical track at a position below the releasably engaged cross-member, and extends through a second opening defined by the body portion, when the first and second opening are aligned.

35. The modular hoarding of claim 34 which the bracket mounts comprise a vertical sleeve fixed to the free end of each of the brackets and located about the post to which the associated bracket is mounted.

36. A method of providing a modular hoarding supported at a pre-selected ground site, comprising the steps of:

providing a plurality of vertical posts;

securing the posts to the ground in spaced apart orientation;

providing a framework by releasably securing a pair of intermediately positioned horizontal cross-members to a pair of adjacent posts;

providing a plurality of abutting panel members;

providing a plurality of vertically offset locking positions along each panel member;

providing a plurality of removable locking members comprising a key portion and a body portion;

releasably securing each panel to the framework at a height selected from the plurality of vertically offset positions by inserting the key portion into a first selected vertical position;

engaging the body portion with one of the elements defined by the group consisting of: one of the intermediately positioned cross-members and one of the posts in the pair of adjacent posts;

aligning a first opening defined by the body portion with a second opening defined at a second selected vertical position; and inserting a fastener through the first and second openings.

37. The method of claim 36 comprising the step of releasably coupling a first cross-member to a second cross-member positioned in adjacent alignment with the first cross-member.

38. The method of claim 37 comprising the step of positioning the horizontal cross-members at selected positions vertically along the posts.

39. The method of claim 38 wherein the cross-members are slidably positioned along the posts and are secured by clamping the cross-members to the posts.

* * * * *

UNITED STATES PATENT AND TRADEMARK OFFICE

CERTIFICATE OF CORRECTION

PATENT NO. : 6,557,666 B1
DATED : May 6, 2003
INVENTOR(S) : Jean Drouin

It is certified that error appears in the above-identified patent and that said Letters Patent is hereby corrected as shown below:

Title page,
Item [76], Inventor, replace "252 Clarence Street" with
-- 250 Clarence Street, Unit 11 --

Signed and Sealed this

Sixth Day of April, 2004

JON W. DUDAS
*Acting Director of the United States Patent and Trademark Office*